United States Patent [19]

Edenhofer et al.

[11] Patent Number: 4,881,982

[45] Date of Patent: Nov. 21, 1989

[54] METHOD FOR GASEOUS CARBURIZATION OF STEEL

[75] Inventors: Bernd Edenhofer, Stuttgart; Hans Pfau, Bedburg-Hau, both of Fed. Rep. of Germany

[73] Assignee: Ipsen Industries International Gesellschaft mit beschränkter Haftung, Kleve, Fed. Rep. of Germany

[21] Appl. No.: 185,862

[22] Filed: Apr. 25, 1988

[30] Foreign Application Priority Data

Apr. 29, 1987 [DE] Fed. Rep. of Germany ..... 3714283

[51] Int. Cl.[4] ..... C23C 11/10

[52] U.S. Cl. ..... 148/16.5; 148/13; 148/16

[58] Field of Search ..... 148/13, 16, 16.5

[56] References Cited

U.S. PATENT DOCUMENTS

| | | | |
|---|---|---|---|
| 3,925,109 | 12/1975 | Nilsen | 148/16.5 |
| 4,108,693 | 8/1978 | L'Hermite et al. | 148/16.5 |
| 4,168,186 | 9/1979 | Limque et al. | 148/16.5 |
| 4,306,918 | 4/1980 | Kaspersma et al. | 148/16.5 |
| 4,306,919 | 12/1981 | Roberge et al. | 148/16.5 |
| 4,372,790 | 2/1983 | Göhring et al. | 148/16.5 |
| 4,472,209 | 9/1984 | Längerich et al. | 148/13 |
| 4,744,839 | 5/1988 | Quelle | 148/16.5 |

FOREIGN PATENT DOCUMENTS

| | | | |
|---|---|---|---|
| 3436267 | 5/1986 | Fed. Rep. of Germany | 148/16.5 |

OTHER PUBLICATIONS

"Prozessrechner zur Steuerung des Diffusionsverlaufs während der Aufkohlung", Dr.-Ing. J. Wünning, 1982, pp. 424–426, Zeitschrift Wirtschaftliche Fertigung-H.9.

"Oxygen Carbon Controller", Process-Electronic Analyse- und Regelgeräte GmbH, Dr.-Ing. J. Wünning, 1983.

*Primary Examiner*—Upendra Roy

*Attorney, Agent, or Firm*—Becker & Becker, Inc.

[57] ABSTRACT

A method for gaseous carburization of steel, where, in a carbon-rich gaseous atmosphere, an article that is to be carburized is, in a first carburization phase, exposed to a carbon charge that is as great as possible, at the black limit, and, in a subsequent diffusion phase, a lower carbon charge that corresponds to the desired carbon content at the surface of the article is established, with carburization being regulated via the two target values carbon content at the surface and depth of carburization. In order, independent of the carbide limit, to provide a regulation with which it is possible to achieve in a straightforward manner, reliably and reproducibly, the desired carbon content curve (carbon profile) in the article, at least one further target value that is characteristic of the carbon content curve is used to regulate the carburization. When this additional target value is reached, the carbon level that characterizes the carburization phase is reduced, and the diffusion phase is initiated.

15 Claims, 7 Drawing Sheets

PRIOR ART Fig.1

METHOD FOR GASEOUS CARBURIZATION OF STEEL

BACKGROUND OF THE INVENTION

The present invention relates to a method for gaseous carburization of steel, where, in a carbon-rich atmosphere, an article that is to be carburized, in a first carburization phase, is exposed to a carbon supply or charge that is as great as possible, at the soot or black limit, and, in a subsequent diffusion phase, a lower carbon charge that corresponds to the desired carbon content at the surface of t he article is established, with carburization being regulated via the two target values carbon content at the surface and depth of carburization.

The basic objective during the carburization of steel is to undertake an enrichment of carbon in a surface layer of the workpiece or article that is to be carburized in such a way that in the atmosphere about the article, especially in a furnace atmosphere, an increased carbon supply or charge exists at an appropriate temperature. The carbon from the atmosphere diffuses into the article, and within the article itself diffuses from the surface layer into the interior of the article, where, at a distance from the surface of the article up to a carburization depth of approximately 3 mm the carburization is perceptible by a carbon content that is clearly greater than that of the base article. The carbon distribution in the article from the surface to the core can be diagrammatically illustrated in the form of a so-called carbon profile. The objective is, by carrying out the process, to achieve an S-shaped carbon content curve having a predetermined surface carbon content and as wide a horizontal zone at the surface as possible.

It is known, for the carburization of steel, to coordinate the performance or execution of the process with the two target values carbon content at the surface $C_R$ and depth of carburization $A_t$. Practically speaking, this is carried out in that initially, in a first treatment phase, the carbon level is set at a value just below the soot or black limit and is held there (carburization phase), and subsequently, in a final stage (diffusion phase), a lower carbon level is used to achieve the desired carbon profile. For this purpose, computers are used which, at least at certain time intervals, are supplied with the process parameters that are noteworthy for the carburization process, such as temperature, oxygen potential, carbon level, carbon flow, and the like, with these parameters or values being utilized as control parameters for regulating the carburization process. A drawback with such a manner of performance or execution of carburization that is coordinated merely with the two target values carbon content at the surface $C_R$ and depth of carburization $A_t$ is that the desired S-curve shape of the carbon profile in the surface layer of the article that is to be carburized cannot be exactly and reproducibly established. The reason for this is that the point in time at which a changeover or shift is made from the carburization phase to the diffusion phase has a decisive impact upon the shape of the carbon profile in the article. If this point in time is selected too early, a carbon profile is obtained that drops off very rapidly from the surface toward the inside, whereas as if the point in time is selected too late, carbon profiles having an over-carburization (shown as a bulge or hump in a graph) occurs. It has been attempted, via multiple simulated calculations, to determine the optimum shifting time that leads to the desired S-shaped carbon profile. Despite this additional calculating and testing effort, deviations, especially where disruptions in the carbon charge occur, cannot be avoided in practice, since the regulation of the carburization process takes into account only t he target values carbon content at the surface $C_R$ and depth of carburization $A_t$.

As a further development of this process for gaseous carburization of steel parts, German Patent No. 31 39 622 Winning dated Apr. 21, 1983 discloses slowly and slightly lowering the carbon level in the carburization phase via an intermediate phase that precedes the final phase, and continuing to do so until that point in time at which the carbon content at the surface $C_R$ has achieved a certain limit $C_R$max. This limit is determined by the onset of carbide formation.

Despite this control value $C_R$max that is added to the performance or execution of the carburization phase to avoid a carbide formation, this measure does not resolve the aforementioned problem of determining the correct point in time in which to shift from the carburization phase to the diffusion phase. Furthermore, under-carburization and over-carburization can occur, and there is no guarantee that the desired S-shaped carbon profile will be established.

It is therefore an object of the present invention, independent of the carbide limit, to provide a regulation of the carburization process via which it is possible to achieve in a straightforward manner that is reliable and reproducible, the desired carbon content curve (carbon profile) in an article. In particular, the present invention, via a two-stage manner of performance or execution of the process, make it possible to set the ratio of carburization time and diffusion time in such a way that as an end result the desired carbon content and case-hardening depth are achieved, and in so doing the carbon content curve receives a surface zone that is as horizontal as possible.

BRIEF DESCRIPTION OF THE DRAWINGS

These and other objects and advantages of the present invention will appear more clearly from the following specification in conjunction with the accompanying drawings, in which the inventive method is schematically illustrated with reference to various exemplary embodiments, and in which.

SUMMARY OF THE INVENTION

Figure 1:
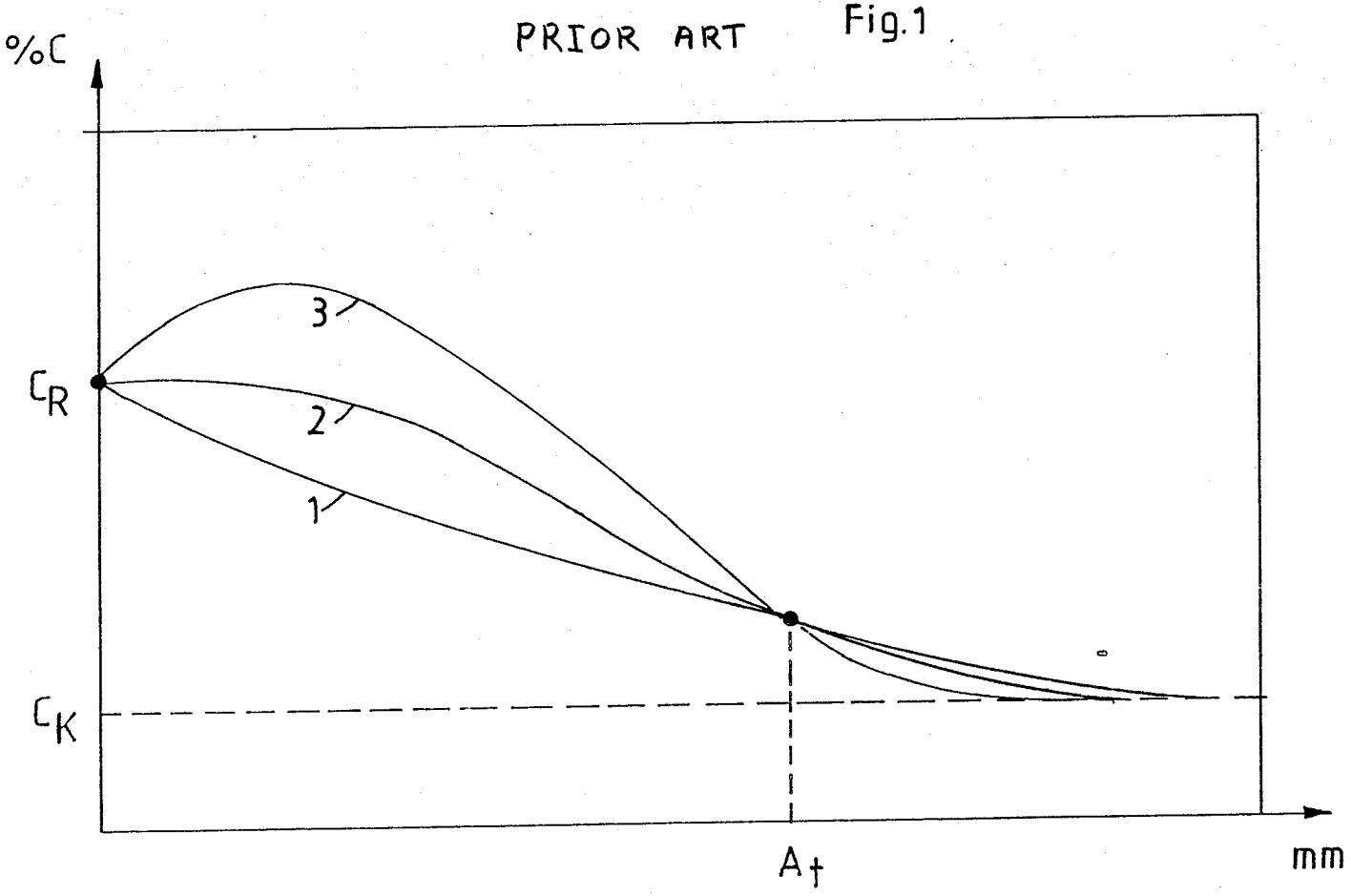
FIG. 1 ia a view that shows various carbon content curves (carbon profiles) that result when carrying out the process of the state of the art.

The method of the present invention is characterized primarily in that in addition to the target values carbon content at the surface $C_R$ and depth of carburization $A_t$ for regulating the carburization, at least one additional target value is used that is characteristic of the carbon content curve, whereby when this additional target value is reached, the carbon level that characterizes the carburization phase is reduced, and the diffusion phase is initiated.

As a result of the inventive disclosure of, in addition to the previous target values for regulating the carburization, making available a further target value that is characteristic of the desired S-shaped carbon content curve, it has become possible to obtain the optimum ratio of carburization time to diffusion time, so that as the end result the desired carbon content at the surface, the desired case-hardening depth, and in addition a carbon content curve having a largely horizontal zone at the surface of the workpiece are achieved. In this connection, it can be expedient to use for the regulation of the carburization a plurality of, preferably three, target values that are characteristic of the carbon content curve in order to assure that the desired and actual carbon profiles correspond to one another.

For this purpose, it can also be advantageous to return the carburization from the diffusion phase to the carburization phase as soon as the carbon content curve falls below the additional target value, whereby when the latter is again reached, a shift is again made to the diffusion phase. A multiple cyclical shifting between the carburization phase and the diffusion phase can frequently lead to a briefer and more precise carburization.

Pursuant to one preferred embodiment of the present invention, the additional target value is a carbon content $C_v$ that is disposed on the calculated carbon content curve at a distance "x" from the surface that is between 15 and 90% of the carburization depth $A_t$; when this carbon content $C_v$ is reached, at a carburization level at the black limit, for example at 1.2% by weight carbon, the process is shifted over to the diffusion phase at, for example, 0.8% carbon. It can also be expedient, in order to achieve a greater reliability and precision, to make available for the regulation, as additional target values, a plurality of carbon contents $C_v^1$ to $C_v^n$ that are disposed on the carbon content curve at appropriate distances $x_1$ to $x_n$ from the surface.

With this method, the inventive carbon profile regulation is preferably carried out in such a way that the desired carbon content curve is analytically defined, and the additional target value or values $C_v$ are determined by empirical values that are fed to the process computer. The carburization process is then started in the carburization phase with a carbon level that is as high as possible just below the black limit, whereby the carbon that diffuses into the article via the increase of the carbon content at the surface $C_R$ is analytically tracked by the process computer and the carbon level is kept constant as long as the calculated carbon content curve is not yet tangential to the prescribed target value $C_v$. When the carbon content curve does reach the target value $C_v$, the carbon level is reduced to a value that corresponds to the prescribed carbon content at the surface $C_R$. The carburization process is continued in the diffusion phase with this reduced carbon level until the desired carburization depth is achieved. If during this carburization process the determined carbon content curve in the diffusion phase again falls below the target value $C_v$, it is disclosed to again raise the carbon level to the value of the carburization phase, whereby this process of the cyclical shifting of the carbon level between the two target values $C_R$ and $C_v$ is continued until the prescribed carburization depth is achieved. With this method, it is possible to always hold the carbon content curve at a point near the additional target value $C_v$, while the penetration depth of the carbon continuously increases until the prescribed carburization depth is achieved.

The carburization is expediently not terminated until, in addition to reaching the carbon content at the surface $C_R$, the depth of carburization $A_t$ and the additional target value $C_v$, also no greater carbon contents than $C_R$ are present in the curve between $C_R$ and $C_v$. In this way, a completely linear carbon content curve is achieved in the outermost surface layer, and even the slightest upward bulging of the carbon content curve in this region is prevented.

Instead of regulating the carburization process via one or more additional points of the carbon profile, it is also possible to establish the additional target value by comparing two surface areas $F_1$ and $F_2$ that are provided by the surfaces between the actual carbon profile obtained at any given point in time, and the desired theoretical carbon profile, with $F_1$ defining the surface that is disposed above the desired theoretical carbon profile, and $F_2$ defining the surface that is disposed below the desired theoretical carbon profile. Shifting from the carburization phase into the diffusion phase is undertaken as soon as $F_1 \geqq K \times F_2$, whereby the factor K can have values between 1.0 and 1.3.

With the method of the present invention, a considerable amount of time is saved compared to the heretofore known method for gaseous carburization. In addition, with the inventive method, for the first time the analytically determined carbon content curve can be reliably maintained for the workpiece or article via a regulating procedure.

Further specific features of the present invention will be described in detail subsequently.

DESCRIPTION OF PREFERRED EMBODIMENTS

Referring now to the drawings in detail, FIG. 1 shows the state of the art, and illustrates that carbon profiles can assume very different shapes if the process is carried out in a faulty manner, especially where an incorrect selection has been made of the cycle times for the carburization and diffusion phases of a two-stage carburization treatment. In such a case, carbon profiles similar to the curves 1 and 3 frequently occur during carburization. As a result, the quality of the case-hardened layer or zone of such components is considerably reduced as a result of a residual austenite content that is too great (curve 3), or as a result of an underhardening, i.e. a hardening that is too slight (curve 1). For this reason, an S-shaped carbon profile having as wide a horizontal region near the surface as possible, as shown in the carbon content curve 2 in FIG. 1, is desired during a carburization process.

Figure 2:
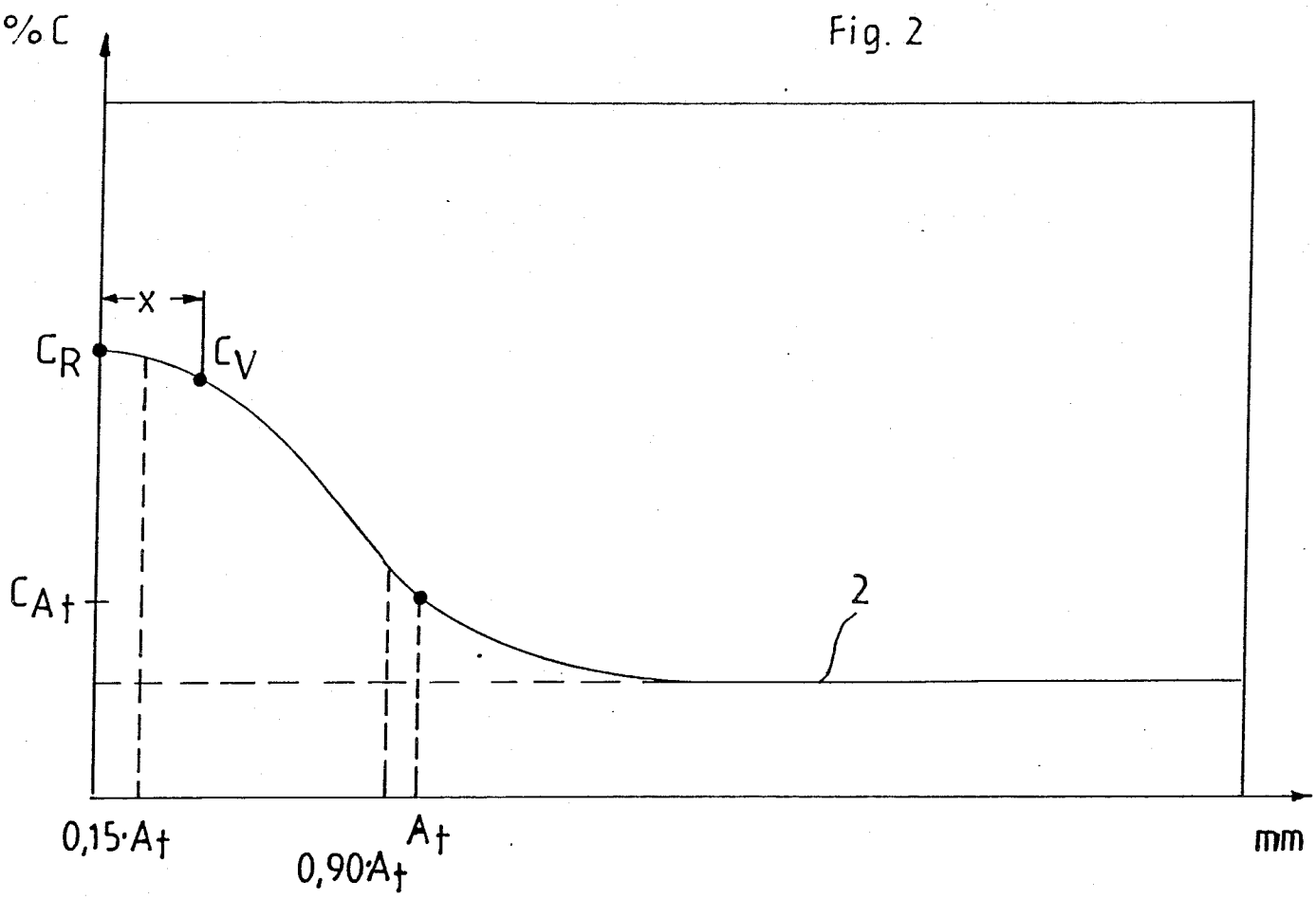
FIG. 2 is a view that shows a carbon content curve where the inventive method is carried out with a target value $C_v$ for a carburization depth $A_t$ of less than 1.0 mm.
Figure 3:
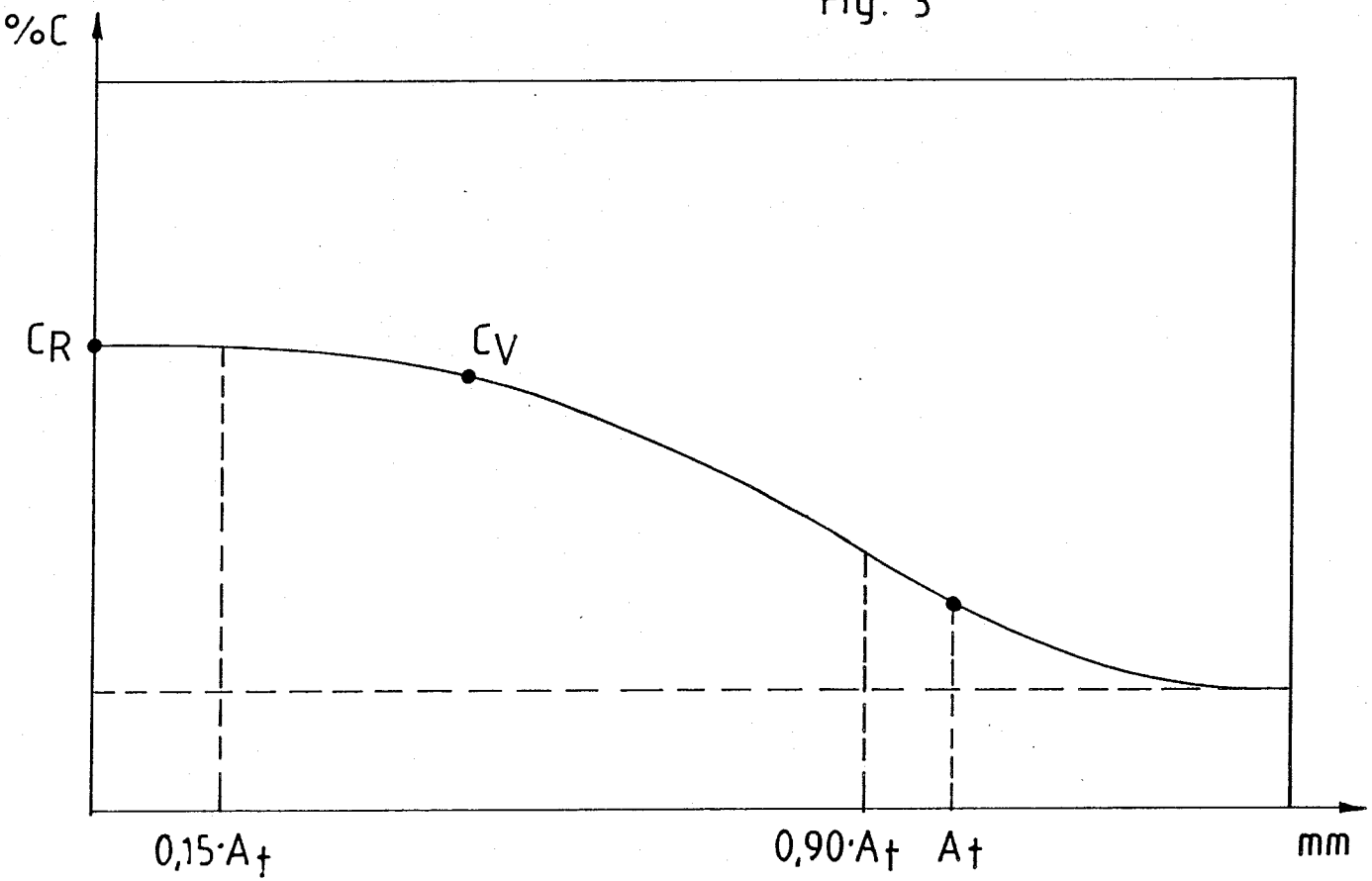
FIG. 3 is a view that shows a carbon content curve where the inventive method is carried out with a target value $C_v$ for carburization depths $A_t$ of greater than 1.0 mm.

To achieve this objective, as a third target value, in addition to the carbon content at the surface $C_R$ and the depth of carburization $A_t$, a point is selected on the desired carbon content curve (curve 2) and is disposed at between 15 and 90% of the desired carburization depth $A_t$; as illustrated schematically in FIG. 2, this third target value is designated $C_v$. While FIG. 2 clearly shows the position of the target value $C_v$ for carburization depths $A_t$ of less than 1 mm, the S-shaped carburization curve of FIG. 3 clearly shows a target value $C_v$ that can be used for greater carburization depths $A_t$ of greater than 1 mm. In both cases, the carburization process is controlled with the aid of a process computer in such a way that all three target values, $C_R$, $C_v$ and $A_t$, and hence the prescribed S-shaped carbon content curve, are achieved.

For this purpose, the desired target curve for the carbon profile is defined and the additional target value $C_v$ is established in the aforementioned range of the profile. The point $C_v$ is established on the basis of empirical values that are suitably entered in the process computer. Where the gaseous carburization is controlled in conformity with the carbon level, the first phase of the carburization process is effected in a conventional manner by setting and regulating a carbon level that is as high as possible, being just below the soot or black limit. The carbon that diffuses in, along with the increase of the carbon content at the surface $C_R$, are analytically tracked by the process computer, and the carbon level is kept constant as long as the computed carbon content curve is not yet tangential to the prescribed target value $C_v$.

When the computed carbon content curve reaches the target value $C_v$, the set carbon level value is reduced to a value that corresponds to the prescribed carbon content at the surface $C_R$. The carbon level is regulated at this value until the carbon content curve again falls below the value of the target value $C_v$.

At this moment, the carbon level is again raised to its original set value, i.e. just below the black limit. As a result, the carbon content curve again rises. When this curve again reaches the target value $C_v$, the aforementioned process is repeated.

As a result of the cyclical shifting of the carbon level between two set values in this phase of the treatment, it is possible to always hold the carbon content curve close to the target value $C_v$, while the penetration depth of the carbon continuously increases until the prescribed carburization depth $A_t$.

As or just before the carburization depth $A_t$ is reached, the process computer holds the carbon level at the lower set value, so that the carbon content at the surface $C_R$ is fixed.

In order to achieve a completely horizontal carbon content curve in the outermost surface layer of the workpiece, the computer is told to terminate the carburization if, in addition to achieving $C_R$, $A_t$, and $C_v$, also no greater carbon contents than $C_R$ are present in the curve between $C_R$ and $C_v$. This additional condition is suited for preventing even the slightest upward curvature of the carbon content curve.

To exemplify the control of a gaseous carburization, in conformity with the carbon level, of a workpiece of 20 Mn Cr 5 steel, the inventive carbon profile regulation will be subsequently described for three different carburization depths of 0.2, 0.9, and 2.0 mm.

Figure 4:
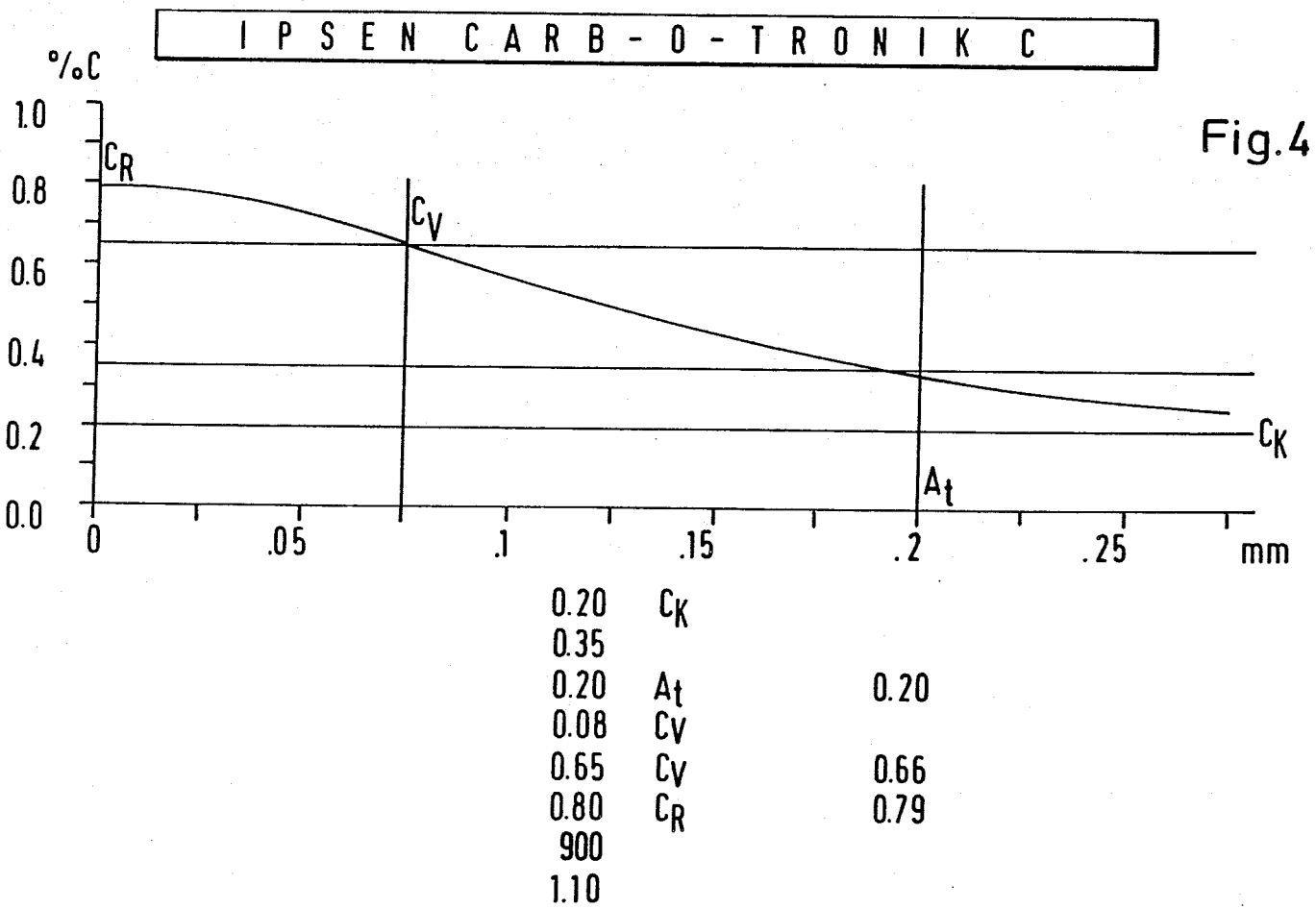
FIG. 4 is a view that shows an embodiment for an inventive gaseous carburization of a 20 Mn Cr 5 steel.

Example of FIG. 4

FIG. 4 shows the situation for a slight carburization depth of 0.2 mm. At the beginning of the process, the carburization temperature is set at 900° C., and the carbon level is set at 1.10% below the black limit. The prescribed target values are as follows:

a. $C_R = 0.80\%$ carbon
b. $A_t = 0.2$mm at 0.35% carbon
c. S-shaped carbon content curve To perform or execute the gaseous carburization process with the above mentioned target values, the position of the regulating point $C_v$ on the carbon content curve is established at 0.65% carbon at 0.08 mm from the surface in the workpiece. The process computer subsequently performs or executes the carburization at the carbon level of 1.10% carbon until the computed carbon curve reaches the point $C_v$. The carbon level is then lowered to the value 0.8%, in other words, the target value of the carbon content at the surface. Further values can be obtained from the drawing.

After a total treatment time of 21 minutes, a carbon content at the surface of 0.79%, a carburization depth $A_t$ of 0.20 mm, and a target value $C_v$ of 0.66% carbon are achieved.

Figure 5:
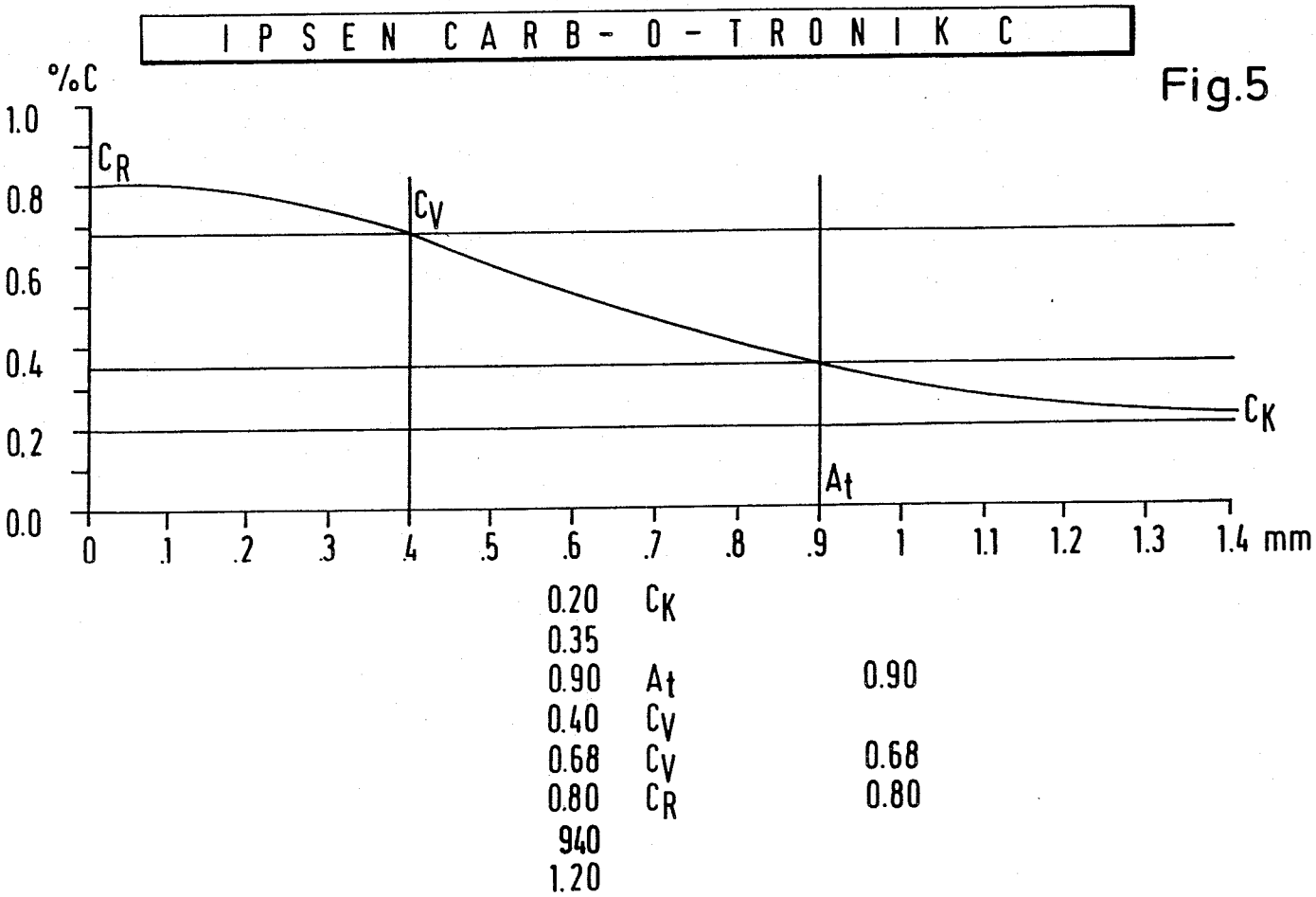
FIG. 5 is a view that shows a carbon distribution for a further inventive embodiment.

Example of FIG. 5

FIG. 5 shows the case for an average or middle carburization depth of 0.9 mm. The prescribed target values are as follows:

a. $C_R = 0.80\%$ carbon
b. $A_t = 0.90$ mm
c. S-shaped carbon profile

A carburization temperature of 940° C. and a carbon level for the carburization of 1.20% carbon are selected. The position of the third target value $C_v$ on the desired S-shaped carbon profile is prescribed at 0.68% carbon at 0.40 mm.

By performance or execution the process pursuant to the present invention, the three target values $C_R$, $A_t$, and $C_v$ are achieved after a total carburization time of exactly 1.88 minutes

Figure 6:
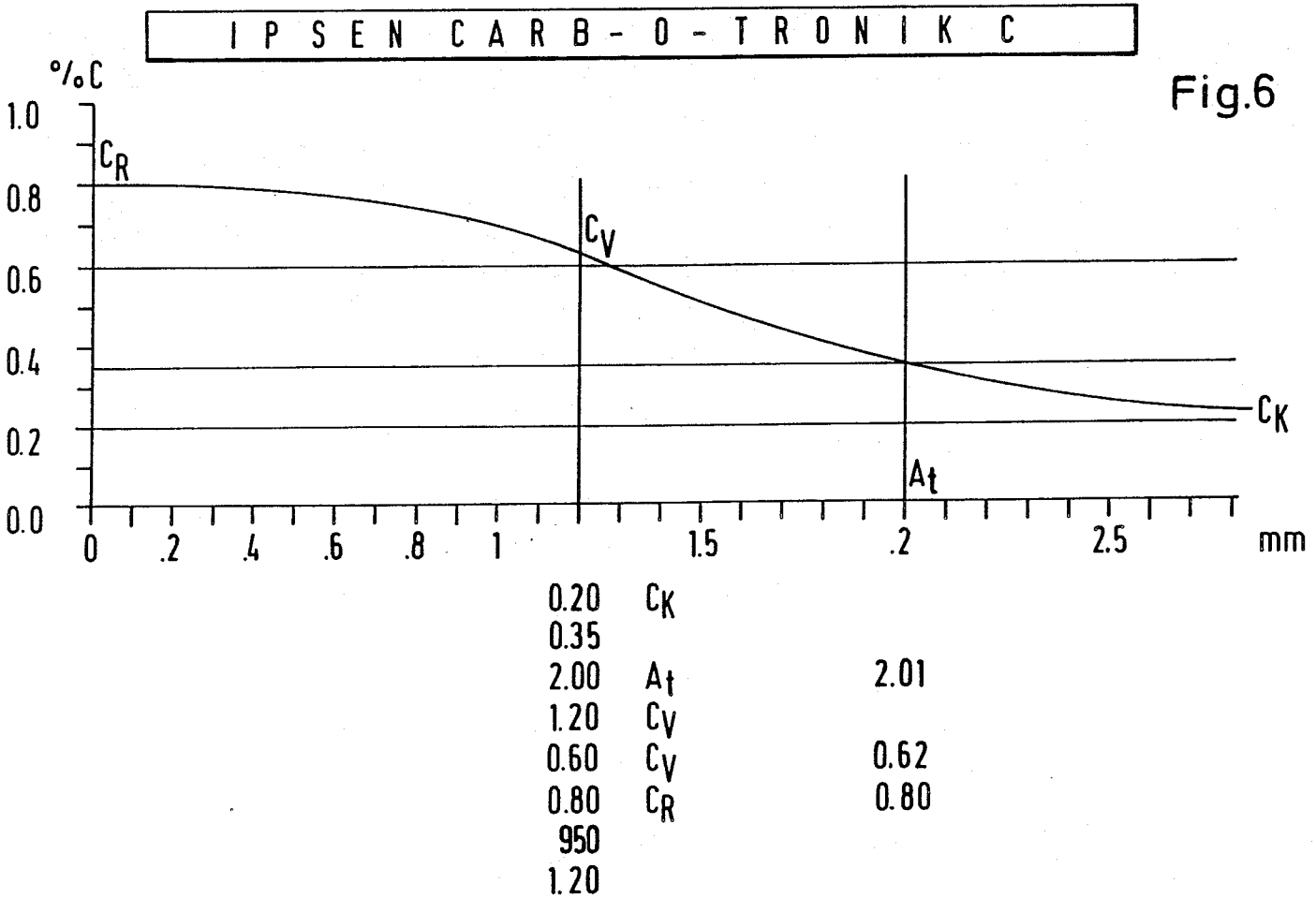
FIG. 6 is a view that shows a carbon distribution for yet another inventive embodiment.

Example of FIG. 6

FIG. 6 shows the case for the great carburization depth of 2.0 mm. The prescribed target values are as follows:

a. $C_R = 0.80\%$ carbon
b. $A_t = 2.00$ mm
c. S-shaped carbon profile

A carburization temperature of 950° C. and a carbon level for the carburization of 1.2% carbon are selected. The position of the third target value $C_v$ on the desired S-shaped carbon profile are prescribed at 0.60% carbon at 1.20 mm.

If the process is performed or executed pursuant to the present invention, these values are achieved after a total carburization time of 847 minutes. The target values $A_t$ and $C_v$ are slightly exceeded, with $A_t$ being 2.01 mm (instead of 2.00 mm) and $C_v$ being 0.62% (instead of 0.60% carbon). The reason for this is that the process computer continued the carburization until there was no longer a carbon value that was higher than $C_R$ between $C_R$ and $C_v$.

Figure 7:
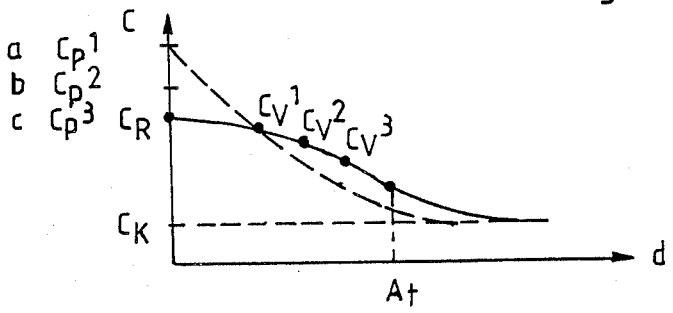
FIG. 7 is a view that illustrates a carbon profile regulation that is carried out via a plurality of additional target values.

FIG. 7 shows a carbon profile regulation via a plurality of additional target values $C_v^1$, $C_v^2$, and $C_v^3$ that are disposed upon the carbon content curve. The control of the carburization process is undertaken as follows:

a. Carburization is undertaken at the high $C_p^1$ values until the target value $C_v^1$ is achieved.

b. The carbon level is lowered from $C_p^1$ to $C_p^2$ approximately by the amount $C_R + \frac{1}{2} \times (C_p^1 - C_R)$, in other words, to a value that is greater than $C_R$ and is less than $C_p^1$; carburization is performed or executed until the additional target value $C_v^2$ is achieved.

c. The carbon level is lowered from $C_p^2$ to $C_p^3 = C_R$, and carburization is performed or executed until the additional target value $C_v^3$ is achieved, at which time the carburization depth $A_t$ is also established.

d. If the carbon profile previously falls below one of the target values $C_v^1$ and $C_v^2$, the carbon level $C_p$ is once again raised to the next higher level, for example from $C_p^3$ to $C_p^2$ or from ($C_p^2$ to $C_p^1$), depending upon which additional target value $C_v$ was exceeded. This $C_p$ value is maintained until the carbon profile again exceeds the $C_v$ value below which it previously dropped. The carburization is subsequently continued as outlined above until the final values are achieved.

Figure 8:
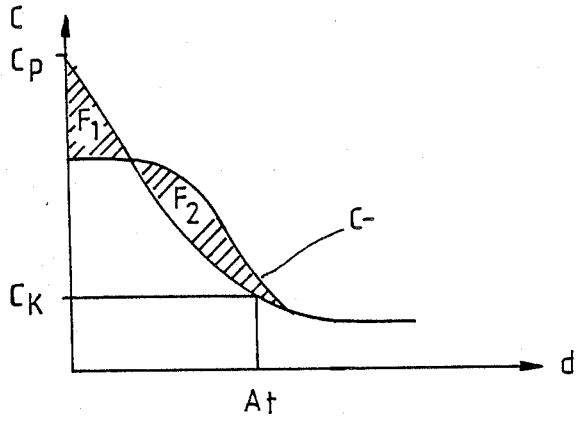
FIG. 8 is a view that illustrates a carbon profile regulation via a comparison of surfaces.

FIG. 8 shows a carbon profile regulation via a comparison of the surfaces. In this connection, the carburization is performed or executed in the carburization phase at a high carbon level until the surface $F_1 \geqq K \times F_2$, whereby the K values can be between 1.0 and 1.3. The process is then shifted to the diffusion phase at a lower carbon level $C_p$ (for example $C_p = C_R$). The diffusion phase is performed or executed until $F_1 = 0$ and $F_2 = 0$. This is determined by the process computer.

If $F_1 = 0$ without $F_2$ being approximately equal to 0, i.e. if $F_2$ is still clearly greater than 0, then the carbon level $C_p$ is again to be increased somewhat, as a result of which $F_1$ also becomes greater than 0. The carburization at a higher carbon level is then continued in conformity with the starting phase.

In contrast, if $F_2 = 0$ without $F_1$ already being approximately equal to 0, i.e. if $F_1$ is still clearly greater than 0, then the process continues to be performed or executed in the diffusion phase until $F_1$ becomes approximately 0.

With the described two-stage processing, comprising the carburization and the diffusion phases, it is possible via the additional target value to obtain the optimum ratio of carburization time to diffusion time, or to make a correction in the carburization phase, so that as an end result the desired carbon content at the surface is achieved at the prescribed case-hardening depth, with the carbon content curve extending horizontally near the surface.

The present invention is, of course, in no way restricted to the specific disclosure of the specification and drawings, but also encompasses any modifications within the scope of the appended claims.

What we claim:

1. In a multi-step method for gaseous carburization of steel, where, in a carbon-rich gaseous atmosphere, an article that is to be carburized is, in a first carburization phase, exposed to a carbon charge that is as great as possible, at the carbon black limit, and, where a determination is made when to shift from the first carburization phase changing over in a subsequent diffusion phase, having a lower carbon charge that corresponds to the desired carbon content at the surface of the article is established, the improvement in combination therewith comprising the steps of:

regulating carburization in conformity with a first target value of carbon content at the surface, a second target value of depth of carburization, and at least one additional target value that is characteristic of the carbon content curve of said article, i.e. carbon distribution in said article graphically represented as carbon content plotted versus depth of carburization, with said regulating being executed in such a way that when said at least one additional target value is reached, automatically switching over to the subsequent diffusion phase wherein the carbon level that characterizes said carburization phase is reduced, and said diffusion phase is initiated.

2. A method according to claim 1, which including using several additional target values for said regulating strip.

3. A method according to claim 1, which includes the steps of returning from said diffusion phase to said carburization phase as soon as the carbon content curve falls below said at least one additional target value, and then shifting back to said diffusion phase as soon as the carbon content curve again reaches said at least one additional target value.

4. A method according to claim 1, which includes the steps of selecting as said at least one additional target value a carbon content that is disposed on the calculated carbon content curve at a distance from the surface that places said at least one additional target value between 15 and 90% of said depth of carburization, and shifting to said diffusion phase, from a carbon level at the black level, when said at least one additional target value is reached.

5. A method according to claim 1, which includes the step of determining an additional target value by comparing two surface areas that are provided by the areas between a desired theoretical carbon profile and an actual carbon profile at any given time, with one of said surface areas defining the area above, and the other of said surface areas defining the area below, said desired theoretical carbon profile.

6. A method according to claim 1, which includes the step of terminating carburization only when, in addition to reaching said target values, no carbon content greater than said carbon content at the surface is present in said carbon content curve between said carbon content at the surface and said at least one additional target value.

7. A method according to claim 2, which includes using three additional target values for said regulating strip.

8. A method according to claim 3, which includes the step of cyclically repeating said returning and shifting back steps as often as necessary.

9. A method according to claim 4, which includes the step of shifting from a 1.2% by weight carbon level to said diffusion phase at a 0.8% by weight carbon level.

10. A method according to claim 4, which includes the step of selecting, as several additional target values, a plurality of carbon contents that are disposed on said carbon content curve at appropriate distances from the surface.

11. A method according to claim 4, which includes the steps of:

analytically defining the desired carbon content curve;

empirically establishing said at least one additional target value and entering the latter in a computer;

beginning said carburization phase with a carbon level that is as high as possible, just below the black limit;

via said computer, analytically tracking the carbon that diffuses into said article via the increase of the carbon content at the surface;

keeping the carbon level constant as long as the calculated carbon content curve is not tangential to the prescribed at least one additional target value;

12. A method according to claim 5, which includes the step of shifting from said carburization phase to said diffusion phase as soon as the area of said one surface area is equal to or greater than the product of the area of said other surface area times a factor.

13. A method according to claim 6, which includes the step of terminating carburization only when said carbon content curve is linear or decreases in a direction away from said carbon content at the surface and toward that one of said at least one additional target values that is furthest from said carbon content at the surface.

14. A method according to claim 11, which includes the steps of again raising the carbon level to that of said carburization phase when said carbon content curve in said diffusion phase drops below said at least on additional target value, and cyclically shifting the carbon level between said carbon content at the surface and said at least one additional target value until the prescribed depth of carburization is obtained.

15. A method according to claim 12, in which said factor has a value of from 1.0 to 1.3.

* * * * *